United States Patent [19]

Gustafsson

[11] 4,244,401

[45] Jan. 13, 1981

[54] HYDRAULIC DRIVER FOR A SHUTTLE

[75] Inventor: Olle Gustafsson, Karlskoga, Sweden

[73] Assignee: Almhults Bruk Aktiebolag, Almhult, Sweden

[21] Appl. No.: 36,903

[22] Filed: May 7, 1979

[30] Foreign Application Priority Data

Nov. 14, 1977 [SE] Sweden ..... 7712816

[51] Int. Cl.[3] ..... D03D 49/34

[52] U.S. Cl. ..... 139/142

[58] Field of Search ..... 139/141, 142, 143, 144; 60/477, 478

[56] References Cited

U.S. PATENT DOCUMENTS

| | | | |
|---|---|---|---|
| 2,488,192 | 11/1949 | Hindle | 139/144 |
| 2,649,118 | 8/1953 | Heath | 139/144 |
| 2,773,517 | 11/1956 | Hooper et al. | 139/142 |
| 3,191,633 | 6/1965 | Piot | 139/144 |
| 3,698,444 | 10/1972 | Hindle et al. | 139/142 |

*Primary Examiner*—Henry Jaudon

*Attorney, Agent, or Firm*—Beveridge, DeGrandi, Kline & Lunsford

[57] ABSTRACT

A hydraulic driver is provided for a loom shuttle. The driver has a hydraulic cylinder (12) with a working piston (59) shiftably disposed in the cylinder for emitting throwing energy direct to the shuttle. There is also a supply valve (11) connected to the hydraulic cylinder (12) and distributing hydraulic fluid from a pressure medium source to the hydraulic cylinder (12) by the intermediary of a pressure accumulator (9) mounted on this cylinder. The supply valve is controlled by a magnet valve (10) directly connected to one end of the supply valve.

10 Claims, 8 Drawing Figures

HYDRAULIC DRIVER FOR A SHUTTLE

The present invention relates to a hydraulic driver for a shuttle in a loom.

The invention is primarily intended for use in large and heavy looms which work with relatively great weave widths, for example, such as those used for weaving blankets and wire gauzes for paper manufacture, carpets and other similar textile goods.

Such looms are provided with one or more shuttles which, by means of a driver, are to be reciprocally thrown through a shed at great speed throughout the entire weave width. In order to realize such driving of shuttles, it is previously known to place one shuttle driver at each side of the loom which strike the shuttle a powerful blow and give it high acceleration on its departure.

Driving of the shuttle may be realized mechanically from the main driving mechanism of the loom with the assistance of mechanical transmission devices in the form of lug straps, picker sticks etc. which convert the rotary movement of a shaft in the machine power apparatus to a reciprocal motion in a shuttle driver, which strikes the shuttle a powerful blow.

A disadvantage inherent in these prior art mechanical drivers is the high noise level, in the form of clattering and rattling, which occurs in the loom.

Another disadvantage is that the mechanical transmission devices are very bulky since they must be dimensioned in order to withstand the great forces which are produced. Moreover, the mechanical parts involved are exposed to wear and require careful maintenance for problem-free operation.

A further disadvantage is that it is difficult to adjust the mechanical devices involved to the different speeds of the shuttle and it is impossible to adjust them for different weave widths.

It is also known in the art to transmit pneumatically generated throwing energy from a compressed air cylinder to the shuttle, either directly or by the intermediary of certain devices. Such pneumatic shuttle drivers have the advantage that the stroke energy need not be taken from the loom driving apparatus, whereby the loom may be made to work more rapidly. Moreover, they possess the advantage that the shuttle throw may be adjusted in a simpler manner. However, it is impossible to avoid the disadvantage inherent in the high noise level, since the outward compressed air discharge which occurs on each shuttle throw entails a very high pollution of the noise environment. Moreover, intermediate devices are also required here in the form of lug straps, picker sticks and special shuttle drivers in order to impart to the shuttle the requisite acceleration in looms with great working widths.

The object of the present invention is to realize a hydrulic driver which is effective, movable for different weave widths, easily adjustable for different shuttle speeds and, as far as is possible, silent in operation. The entire driver apparatus consists of a small, compact unit by means of which a high shuttle velocity may be realized and which may simply be adjusted along the lathe of the loom for different weave widths.

That which substantially characterizes the apparatus according to the invention is that it includes a hydraulic cylinder with a working piston shiftable therein for emitting throwing energy direct to the shuttle, and a supply valve connected to the hydraulic cylinder and distributing hydraulic fluid from a pressure means source to the hydraulic cylinder via a pressure accumulator mounted on the hydraulic cylinder, the supply valve being controlled by a magnet valve directly connected to one end of the supply valve, the entire apparatus being designed as a compact unit mounted on the lathe of the loom.

Since the apparatus is designed as a compact unit, that is to say the different parts of the apparatus have been placed closely adjacent one another, the volume of the active hydraulic liquid in the apparatus will be slight, the system pump for the supply of hydraulic liquid may be of moderate size and the supply conduit may be short and of slight dimensions. Since the working piston of the hydraulic cylinder is directly operative on the shuttle, the need for all movable and space-demanding mechanical intermediate devices is eliminated. Furthermore, since the apparatus is mounted on the lathe of the loom, the apparatus may simply be adjusted for different weave widths in that it is moved along the lathe.

The invention will be described in greater detail hereinbelow with reference to the accompanying drawings which shown an advantageous embodiment of the invention.

FIGS. 1*a* and 1*b* are schematic overviews of a loom provided with a driver according to the invention, it being apparent from these figures how the driver may be adapted to different weave widths.

Figure 1A:
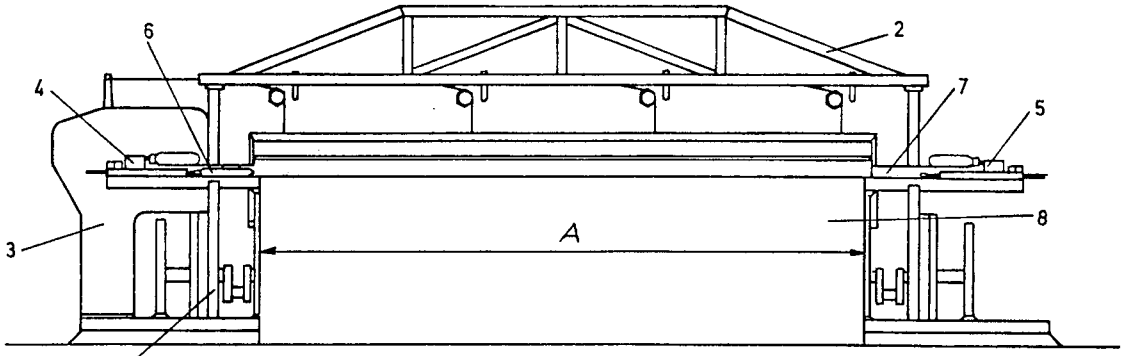
Figure 1B:
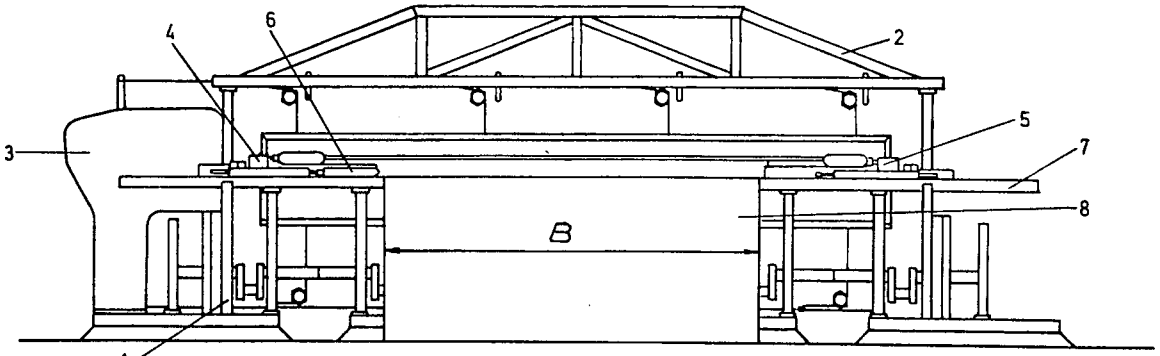

FIGS. 1*a* and 1*b* show the major features of a loom provided with a hydraulic driver according to the invention. The loom is provided with a framing 1 and super-structure 2 and includes main driving works 3 of a known type for driving the different mechanisms of the loom. The loom is provided with two shuttle drivers 4 and 5 placed at each end of the loom for throwing a shuttle 6 across the width of the loom. A pivotal batten or lathe 7 is provided for retaining the weft threads inserted in the shed. Apart from the shuttle drivers, the parts mentioned above are of a conventional type and will not, therefore, be described in any great detail.

FIG. 1*a* shows the loom set for maximum weave width A. The two shuttle drivers 4, 5 are placed on each side of the woven fabric 8 and are mounted furthest out on the lathe 7. The shuttle 6 is located in its one end position and is ready to be thrown by means of the driver 4 over to the opposite side of the loom where it is cushioned and assumes its opposite end position adjacent the second driver 5. This procedure is thereafter repeated such that the shuttle is thrown back from the opposite end position by the second driver 5 to its first position.

FIG. 1*b* shows the loom adjusted for a smaller weave width B. In this case, the two drivers 4 and 5 have been moved from their outer end positions inwardly along the lathe 7. This movement is made possible because the entire driver consists of a small compact unit which is mounted on the lathe. In order to facilitate adjustment of the two drivers, the lathe is suitably provided with a number of holes along its length so that the drivers may simply be fixedly retained at any given point along the lathe. The advantage inherent in the ability to adapt the drivers to different weave widths is the resultant reduction in loss of weft thread and that less energy is consumed for the shuttle throwing operation when the weave width is reduced as in B, as compared with the case when the drivers are fixedly mounted and must be adapted for maximum weaving width A.

Figure 2:
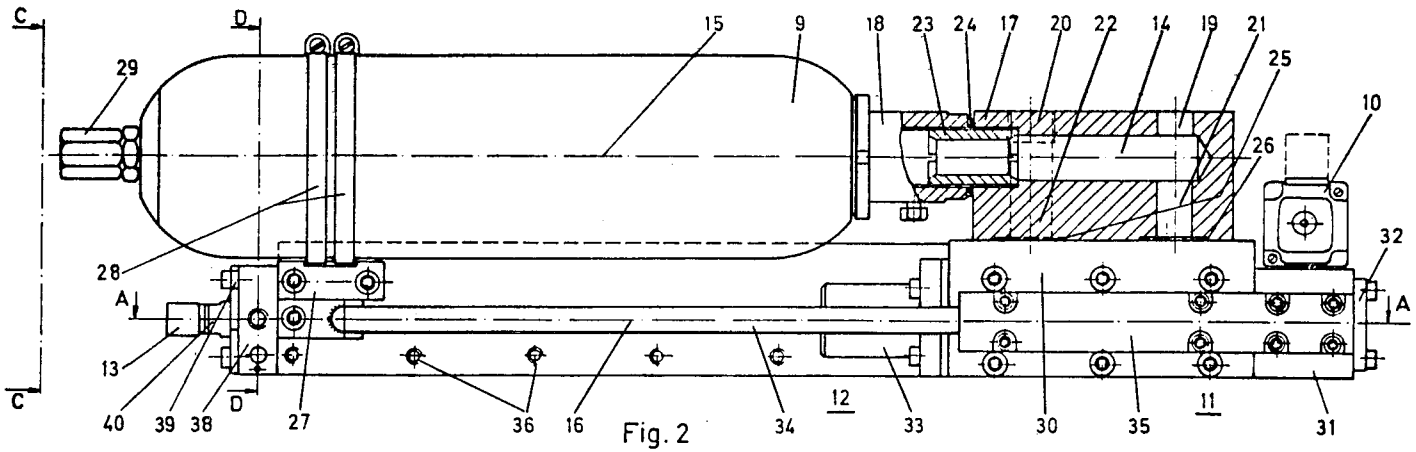
FIG. 2 is a side elevation, partly in section, of the driver.

FIG. 2 shows a side elevation of a hydraulic shuttle driver according to the invention. The major parts of the driver consist of a pressure accumulator 9, a magnet valve 10, a supply valve 11 and a throwing device 12 with a hammer 13 for direct action upon the shuttle.

The pressure accumulator 9 consists of a hydraulic-pneumatic pressure accumulator of a known type which is included in the hydraulic system in order to satisfy the great and short-lived power needs which occur in the throwing movement. A hydraulic fluid of suitable type is included in the hydraulic system, for example, hydraulic oil. Consequently, the expression "oil" will hereafter be used throughout for the hydraulic fluid, for the purposes of simplicity. The pressure accumulator is preloaded to the desired operational pressure and supplies oil to the throwing device 12 by the intermediary of a supply conduit 14 and the above-mentioned supply valve 11. In order to achieve the desired shuttle velocity without excess oil flow in the supply conduit 14, the pressure accumulator is placed as close to the supply valve 11 and throwing device 12 as possible. Thus, the pressure accumulator is mounted on the throwing device itself such that its longitudinal axis 15 is substantially parallel to the longitudinal axis 16 of the elongate throwing device. The connection between the pressure accumulator 9 and the supply valve 11 consists of an intermediate member 17 which is connected to the connecting portion 18 of the pressure accumulator and to the supply valve. The pressure accumulator 9 is connected to a system pump included in an oil assembly, not shown on the drawing, via the supply conduit 14 and an inlet opening 19 in the intermediate member. Apart from the inlet opening there is also an outlet opening 20 which connects the supply conduit to the oil assembly. As is apparent from FIG. 2, the inlet opening 19 is, by the intermediary of the supply conduit 14, in direct communication with an inlet opening 21 to the supply valve 11 and, analogously, the outlet opening 20 is in communication with an outlet opening 22 to the supply valve.

The intermediate member 17 is connected to the connecting portion 18 of the pressure accumulator by the intermediary of an interior tube section 23 and a sealing ring 24. The connections between the intermediate member 17 and the supply valve 11 are sealed each by means of O-ring 25 and 26, respectively.

The pressure accumulator 9 is fixedly mounted on the throwing device 12 by means of a bracket 27 and two hose clamps 28. The pressure accumulator is provided with a valve 29 for connection to a source of gas under pressure for preloading the accumulator.

The magnet valve 10 is of a conventional type and controls the supply valve 11 such that this opens and closes the oil supply to the working piston of the throwing device. The magnet valve is, in its turn, electrically controlled in that an electric impulse triggers the valve in a known manner.

Like the throwing device 12, the supply valve 11 will be described in greater detail in conjunction with FIGS. 4–6 which show a section of the two parts along the line A—A in FIG. 2. In FIG. 2 only the outer details are shown. Thus, the supply valve consists of a valve housing 30 with connection openings to the intermediate member 17 and to the throwing device 12, and a valve mounting 31 for connection to the magnet valve 10. The free end portion of the valve mounting is sealed by means of a lid 32. Furthermore, the supply valve includes a spring housing 33 which, apart from accommodating a valve spring, serves as a sealing member for the other end of the supply valve. A bleeder pipe 34 from the throwing device is connected to the supply valve by the intermediary of a connection plate 35.

The throwing device is enclosed in an elongate casing provided with holes 36 for fixing the throwing device on the lathe 7 of the loom. The casing is sealed at its rear by an end block 37 (please see FIG. 4) and, at its front, by two lids 38, 39 provided with an opening through which the piston rod 40 runs. The piston rod is provided with a head, the hammer 13, which, during the throwing stroke and also during the final phase of the cushioning action, is in direct contact with the shuttle. The head must be made of a material which will tolerate the impact which occurs on contact with the shuttle, for example of plastic.

Figure 3:
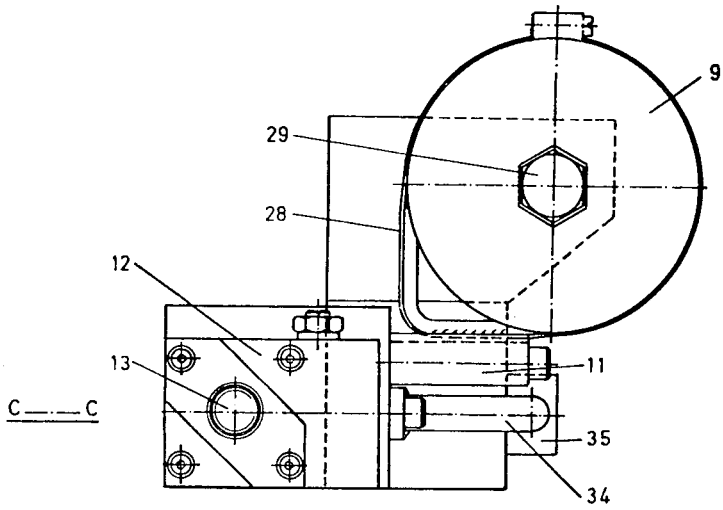
FIG. 3 is an end elevation of the driver seen from the line C—C in FIG. 2.

FIG. 3 shows the driver seen from the front along the line C—C in FIG. 2. In this figure, the same reference numerals as in FIG. 2 have been used for corresponding parts. This figure shows the mutual position of the different parts, and also shows that the constructional principle in this apparatus was to place the different parts as close to each other as possible. This is for two reasons, partly in order that the apparatus shall have as small a cross-sectional area as possible to facilitate shifting of the apparatus along the lathe, and partly in order that supply conduits etc. shall be as short as possible, which in its turn entails that the amount of oil which is set in motion at each throw will be small. As a result of this placing, practically all of the amount of oil which is consumed for one throw of the the throwing device 12 will be supplied by the pressure accumulator. The pressure accumulator is then refilled from the pump of the oil assembly, which may, therefore, also be moderate size.

Figure 4:
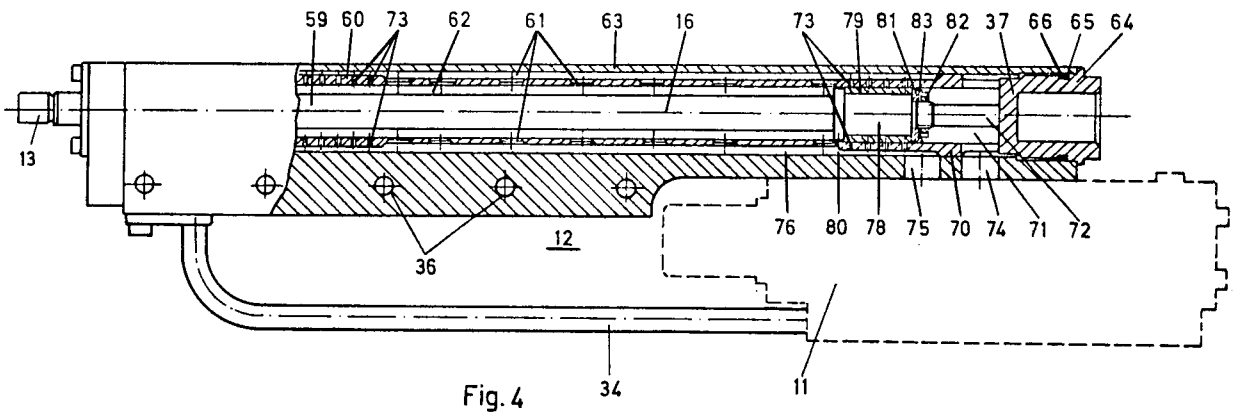
FIG. 4 is a longitudinal section through the throwing device and supply valve taken along the line A—A in FIG. 2.
Figure 5:
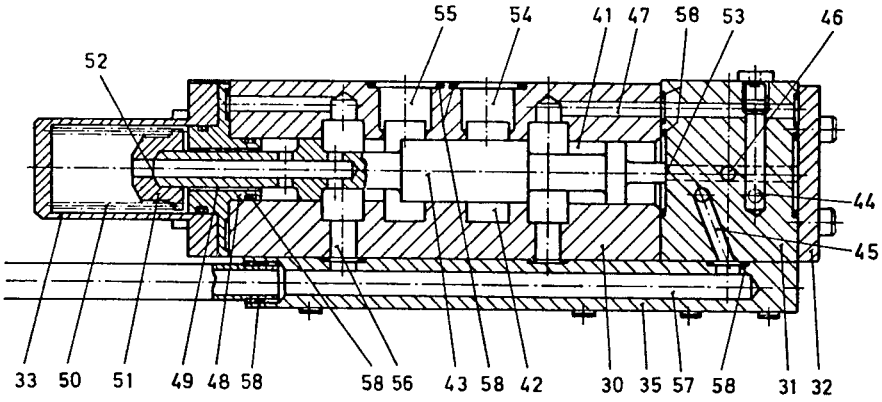
FIG. 5 shows a corresponding longitudinal section of the supply valve on a larger scale.
Figure 6:
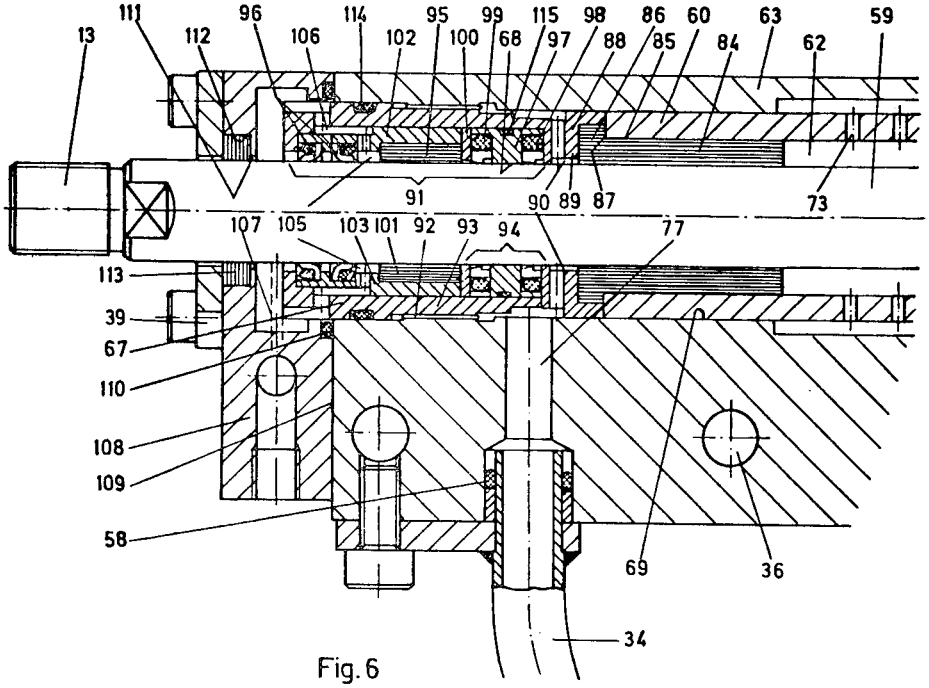
FIG. 6 shows a corresponding longitudinal section of one end portion of the throwing device on a larger scale.

FIG. 4 is a longitudinal section through the throwing device 12 and the supply valve 11 along the line A—A in FIG. 2, the supply valve and certain parts of the throwing device being shown on a larger scale in FIGS. 5 and 6, respectively. The valve housing 30 of the supply valve has a bore in the form of a central passage 41 in which a piston 42 is reciprocally movable along the longitudinal axis 43 of the valve, please see FIG. 5. One end of the valve housing, the right-hand end in the figure, is connected to a valve mounting 31 which forms the connecting portion of the supply valve to the magnet valve 10. The valve mounting consists of three bores 44, 45 and 46, the bores 44 and 45 forming an inlet line and outlet line, respectively, for the oil supply of the magnet valve, and the bore 46 forms a channel for oil for regulating the piston 42. The inlet line 44 is connected to the central passage 41 in the valve housing via a supply conduit 47, whereas the outlet line 45 is connected to a bleeder conduit 57. The free end portion of the valve mounting is sealed by means of a lid 32.

The other end of the valve housing, the left-hand end in FIG. 5, is connected to a guide flange 48 with a central opening 49 through which runs the valve piston rod 42. The guide flange is, in its turn, connected to a spring housing 33 which contains a spring 50 which urges a spring holder 51 against the left-hand end portion 52 of the piston, so that the piston 42 abuts, in its rest position, with its right-hand end portion 53 against the valve mounting.

The wall of the valve housing is bored with openings 54, 55 which connect the passage 41 with the inner cylinder regions in the throwing device 12. The opening 54 then forms an inlet conduit for oil supply to the throwing device, whereas the opening 55 forms a return oil conduit from the throwing apparatus. The wall of the valve housing is, further, bored with openings (not shown) which connect the passage 41 with the earlier-described inlet and outlet openings 21 and 22, respectively, to the system pump and pressure accumulator. An opening 56 of smaller diameter is provided in the wall of the valve housing and connects the bleeder pipe 34 via a conduit 57 in the connecting plate 35 to the return oil conduit. For sealing at the various connections, a number of O-rings 58 have been mounted in a per se known manner.

The throwing device 12 consists of a working piston 59 which is enclosed in a double-wall hydraulic cylinder with the inner cylinder wall 60 bored with a great number of holes 61. The working piston 59 is operative to carry out a reciprocal movement along the longitudinal axis 16 of the throwing device in the inner cylinder region 62 and is provided forwardly with a hammer 13 in the form of a rubber buffer which projects from the end of the outer casing 63.

In its inner region, the outer casing 63 accommodates, apart from a cylinder lining which forms the above-mentioned inner cylinder wall 60, an end block 37 which is inserted at the rear in the outer casing and seals the inner region. The end block abuts with a flange 64 against the end surface of the outer casing and is sealed with respect to the inner wall of the casing by means of a support ring 65 and an O-ring 66. Forwardly, the casing is sealed by means of sealing portion 67 with a central opening 68 through which the rod of the working piston may reciprocally move. The sealing portion 67 is described in detail in conjunction with FIG. 6 below.

The cylinder lining which forms the inner wall 60 is shorter than the outer casing and abuts with its one end portion against the inner wall 69 of the outer casing, please see FIG. 6, which here is of reduced inner diameter, that is to say the wall of the outer casing 63 is thicker. At its opposite end portion, the cylinder lining is provided with a flange 70 of greater diameter which abuts against the inner wall of the outer casing so that a space 71 is formed between the end portion of the cylinder lining and the end block 37. In FIG. 4, the working piston is located in its right-hand end position, the piston abutting via a narrower end portion 72 against the end block 37. As was mentioned above, the cylinder lining is provided with a number of through holes 61. Moreover, the cylinder lining is provided with a number of holes 73 of small diameter at both ends. These holes serve to throttle the oil flow and thereby brake the piston and piston rod, as will be more clearly apparent below. At these end portions, the wall thickness of the cylinder lining is also greater.

The wall of the outer casing is provided with an inlet opening 74 which communicates the inlet opening 54 in the supply valve housing 30 with the space 71 behind the piston rod, and an outlet opening 75 which forms a return oil conduit and communicates the outer cylinder region 76 with the opening 55 in the supply valve housing. Furthermore, the wall of the outer casing is, at its forward end, bored with an opening 77, for by-pass leaking oil, which, via a sealing O-ring 58, is connected to the bleeder pipe 34 which is provided with a flange and is connected to the connection plate 35 of the supply valve.

The piston proper consists of a cylindrical portion 78 around which a bushing 79 is disposed, which, during the movement of the piston, seals against the inner surface of the inner cylinder wall 60. The bushing 79 is kept in place by means of a disco 80 at the front and a washer 81 which is urged against the piston by means of locking nut 82 and a locking washer 83.

The sealing portion 67 includes a piston rod guide 84 in the form of a bushing which includes a relatively elongate portion 85 which is inserted into the inner cylindrical region 62, and an angled end portion 86 which abuts against the end surface 87 of the inner cylinder wall 60. The bushing is kept in place by a ring 88 of L-shaped cross-section, which abuts against the inner surface 69 of the outer casing portion. The ring has a central opening 89 of a diameter which exceeds the diameter of the piston rod such that a circular space 90 is formed between the ring and the piston rod. This space is in communication with the opening 77 in the casing wall 63. In this space 90, the oil which leaks past the piston rod guide 84 is collected and led off via the opening 77 in the bleeder pipe 34.

The sealing portion 67 further includes a sealing unit 91 which is fixed in the inner surface of the casing wall by means of a thread 92. The sealing unit includes a sleeve 93 which retains, counting from the inside and outwardly, a low-friction sealing 94, a bushing 95 and a double-action stripper 96. The sleeve 93 is provided with a recess on its outer surface in which an O-ring 114 has been disposed for sealing against the inner surface of the casing. The low-friction sealing 94 includes a holder 97 which is of T-shaped cross-section and has a central opening for the piston rod and retains two sealings 98, 99. On its outer surface, the holder 97 is provided with a recess in which an O-ring 115 has been disposed for sealing against the inner surface of the sleeve 93. The low-friction sealing is spaced from the bushing 95 by means of a washer 100. The bushing 95 is kept in place by means of an inner sleeve 101 which abuts against the end surface of the stripper 96. The sleeve 101 consists of an elongate cylindrical portion 102 which surrounds the bushing 95, and an angled portion 103 which abuts against the end surface of the bushing. The central opening of the sleeve is of a diameter which exceeds the diameter of the piston rod such that an annular space 105 is formed between the stripper 96 and the bushing 95. In this space, the oil which is wiped off by the stripper 96 is collected and led off via an outlet conduit 106 to a receptacle space 107.

A sleeve 108 is disposed ahead of the sealing portion 67 and abuts against the end surface 109 of the outer casing, an O-ring 110 forming a sealing between the two parts. The sleeve is provided with an opening 111 for the piston rod and a circular recess 112 is provided around this opening, in which recess a felt sealing 113 is disposed. A lid 39 is, finally, mounted ahead of the sleeve 108 so that it abuts against the end portion of the sleeve and the felt sealing.

Figure 7:
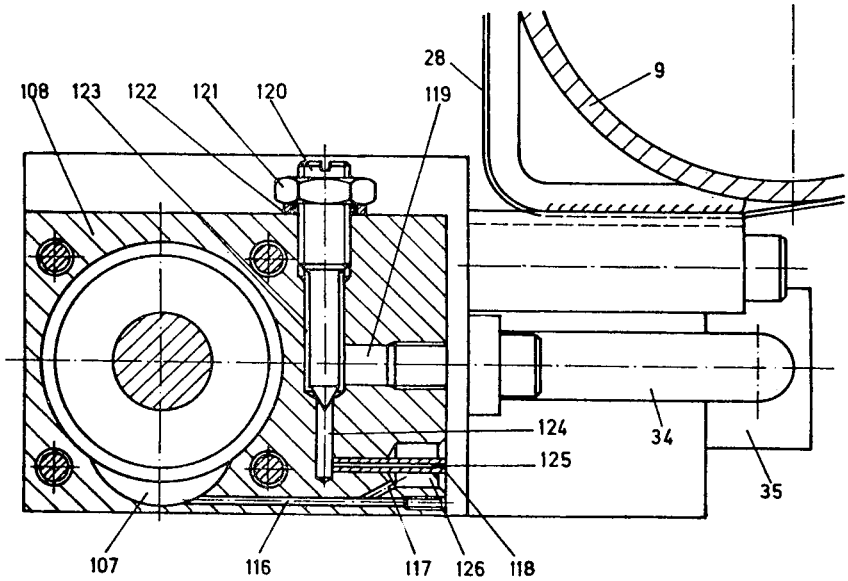
FIG. 7 is a cross-section along the line D—D in FIG. 2.

The oil wiped off by the stripper 96 is led from the receptacle space 107 via a bleeder channel 116 out into the open air, please see FIG. 7. In order to improve the oil bleeding, the channel 116 is connected via a side channel 117 to an ejector 118. Compressed air is led in through the opening 119 and regulated so as to form an air jet by means of a set screw 120 which, via a nut 121 and a sealing ring 122, is disposed in an opening 123 in the sleeve 108. The air jet is led via channels 124 and 125 to an open space 126 in the wall of the sleeve, the oil removal channel 117 discharging into this space. Because of the high velocity of the air jet, a partial vacuum will be created in this space which withdraws oil by suction from the receptacle space 107.

An account will be presented below of the function of the driver in conjunction with a working cycle of the throwing device. In the start position, the working piston 59 is fully retracted in the hydraulic cylinder so that its end portion 72 abuts against the end block 37. The shuttle 6 abuts against the hammer 13 of the working piston. When the shuttle 6 is to be thrown through a shed, an electric impulse is impressed in a known manner on the magnet valve 10 which is thereby triggered and, via the inlet line and channel 44 and 46 in the valve mounting 31, supplies oil to the supply valve. The valve piston 42 which initially is located in its right-hand end position as a result of the pressure from the spring 50, is then shifted to the left in FIG. 5 and opens the inlet 54 to the throwing device. As a result, oil is now supplied from the pressure accumulator to the working piston 59 via the inlet opening 74.

In the throw, the oil which is located ahead of the piston in the inner cylinder region 62 must be removed and this is effected such that the oil is led over to the outer cylinder region 76 via the holes 61. Thus, both the inner and outer cylinder regions are placed under pressure when the throw is to be made, and the active area which is influenced by the pressure is the surface area of the piston rod. During the throw, no oil passes to the return oil conduit. This is an advantage, since the flow resistance in the valve and return conduit which would otherwise occur is now avoided.

At the end of the throw, the working piston 59 is moving at great speed and must be arrested. The inner cylinder wall 60 has, therefore, a number of holes 73 of small diameter at its outer end, and the oil on the front side of the piston is pressed out through these holes to the outer cylinder region 76. According as the piston, in its movement, covers over the holes 73, a gradually increasing throttle effect will be realized of the oil flow from the front side of the piston, and thereby a resultant arresting of the working piston.

As was mentioned above, the apparatus has been constructed such that no return oil losses occur, in order to realize as high a shuttle velocity as possible, up to 20 m/s. Moreover, the working piston is of single-action type and its return stroke is produced by an exterior compressed air cylinder. At this point, the working piston is retracted into the cylinder to a position whence cushioning of the shuttle may be effected by means of the working piston. This means that the working piston should not be completely retracted into the cylinder. In order to adapt the cushioning position to the velocity of the shuttle, this position is suitably adjustable. The cushioning of the shuttle on its return is first effected by means of per se known mechanical members, for example by means of a resilient arm or the like. The final cushioning and arresting of the shuttle then takes place in a similar manner as at the end of the throw, that is to say the oil which is to be found behind the piston is forced out through a number of small holes 73 to the outer cylinder region 76, these holes being progressively covered over by the piston during its movement, with an increased throttle effect of the oil flow as a result.

During the return stroke of the working piston and arresting of the piston, the double cylinder is in communication with the return oil conduit 75. However, only a volume which corresponds to that of the protracted piston rod is to be then evacuated, that is to say approximately 100 $cm^3$. Of this volume, only the volume from the braking distance, approximately 10–12 $cm^3$ will be forced out rapidly.

It is essential that the sealing of the piston rod is designed such that no oil leaks out. Because of the high velocity of the piston rod and the high pressures involved, it is difficult to realize effective sealing in a conventional manner. It is well-nigh impossible to find any form of sealing which withstands both the high drive and cushioning pressures and the high piston rod velocity. Consequently, the sealing portion 67 is designed such that the piston rod guide 84 forms a passable seal for the brief pressure peak, whereafter the actual seal 91 need only seal against the bleeding pressure. This entails that wear and heat generation at the sealing are kept at the lowest possible level. The oil which leaks past the piston rod guide is led out through the bleeder pipe 34.

When the piston rod, during the throw, is advanced at great velocity, it is impossible to dry the piston rod completely; a minor amount of moisture on the rod will always remain. This moisture is later wiped off by means of the stripper 96, so as to form a droplet. This oil is then let via the receptacle box 107 and bleeder channels 116 and 117 to the ejector 118 where it is removed by suction, please see FIG. 7. The ejector has proved to be of great importance inasmuch as it provides an effective bleeding of the receptacle box 107. As a result, the risk that the felt sealing 113 will be saturated with oil is reduced, which might otherwise have occasioned injurious oil leakage.

The invention is not restricted to the embodiment shown above by way of example, but may be modified within the spirit and scope of the following claims.

I claim:

1. A hydraulic driver for a shuttle in a power loom, characterized by a single action type hydraulic cylinder (12) with a working piston (59) shiftable therein for emitting throwing energy direct to the shuttle (6), and a supply valve (11) connected to the hydraulic cylinder (12) and distributing hydraulic fluid from a pressure means source to the hydraulic cylinder (12) via a pressure accumulator (9) mounted on the hydraulic cylinder, said supply valve being controlled by a magnet valve (10) directly connected to one end of the supply valve, substantially all of the hydraulic fluid amount used for one stroke of the working piston being supplied by the pressure accumulator (9) which is then refilled from the pressure means source and the return stroke of the working piston (59) being produced by an exterior compressed air cylinder, the entire apparatus being produced as a compact unit mounted on the lathe (7) of the loom.

2. The driver as recited in claim 1, characterized in that the hydraulic cylinder (12) is two-walled, with the inner cylinder wall (60) bored with a great number of holes (61), such that the hydraulic fluid which is located ahead of the working piston (59) is transferred in a throw to the outer cylinder region (76) between the inner and outer cylinder walls.

3. The driver as recited in claim 2, characterized in that the inner cylinder wall (60) includes, at its ends, a portion with a number of holes (73) of small diameter, through which holes the hydraulic fluid on the forward side of the working piston (59) is pressed out to the outer cylinder region (76), a gradually increasing throttle effect of the hydraulic fluid flow from the forward side of the working piston (59) being obtained according as the working piston (59), in its movement, covers over the holes (73), whereby an arresting of the working piston is realized.

4. The driver as recited in claim 3, characterized in that the inner cylinder region (62) is in communication with a return oil conduit (75) only during the return stroke of the working piston (59).

5. The driver as recited in claim 4, characterized in that the working piston (59), on its return stroke, is adjusted, by the compressed air cylinder, in a position not fully retracted in the hydraulic cylinder (12), and that the return stroke is completed with the aid of the shuttle (6) on its return, the shuttle being cushioned by the working piston (59) by means of said throttle effect on the hydraulic fluid flow through the holes (73).

6. The driver as recited in claim 1, characterized in that the piston rod of the working piston (59) is sealed by means of a sealing portion (67) with a piston rod guide (84) which is disposed to seal passibly against the high but brief throwing and cushioning pressures, and with a sealing unit (91) which is disposed to seal against the bleeding pressure of the hydraulic system.

7. The driver as recited in claim 6, characterized in that the sealing unit (91) includes a low-friction sealing (94), a bushing (95) and a double-action stripper (96) for wiping hydraulic fluid from the piston rod.

8. The driver as recited in claim 7, characterized in that the hydraulic fluid wiped from the piston rod is led via an outlet conduit (106) to a receptacle area (107).

9. The driver as recited in claim 8, characterized in that the receptacle area (107) is connected by the intermediary of a bleeder passage (116) to a compressed air-driven ejector (118) for removal of hydraulic fluid from the receptacle area (107) by suction.

10. The driver as recited in claim 6, characterized in that the sealing portion (67) includes a space (90) which is disposed to collect the hydraulic liquid which leaks past the piston rod guide (84), which space is via an opening (77) in the outer wall (63) of the hydraulic cylinder, in communication with a bleeder pipe (34) for leading-off hydraulic fluid back to the hydraulic system.

* * * * *